US005522236A

United States Patent [19]

Jensen et al.

[11] Patent Number: 5,522,236

[45] Date of Patent: Jun. 4, 1996

[54] ROTATABLE REFRIGERATING DISC FOR ICE MAKING APPARATUS

[75] Inventors: Stefan S. Jensen, Samford; John M. Silvester, Upper Mt. Gravatt, both of Australia

[73] Assignee: Heat and Control Pty. Ltd., Mt. Gravatt, Australia

[21] Appl. No.: 294,075

[22] Filed: Aug. 22, 1994

Related U.S. Application Data

[63] Continuation-in-part of Ser. No. 121,662, Sep. 15, 1993, abandoned, which is a continuation of Ser. No. 882,842, May 14, 1992, abandoned, which is a division of Ser. No. 458,670, Jul. 6, 1990, Pat. No. 5,157,939.

[51] Int. Cl.[6] ..... F25C 5/12

[52] U.S. Cl. ..... 62/354; 165/94

[58] Field of Search ..... 62/354; 165/94, 165/168, 170

[56] References Cited

U.S. PATENT DOCUMENTS 1,961,660 6/1934 Fehrmann ..... 165/170

3,191,398 6/1965 Rader ..... 62/354 X 3,863,462 2/1975 Treuer ..... 62/354 X

*Primary Examiner*—William E. Tapolcai

*Attorney, Agent, or Firm*—Flehr, Hohbach, Test, Albritton & Herbert; Donald N. MacIntosh

[57] ABSTRACT

Rotatable refrigeration disc is of laminated construction comprising at least two layers bonded together, and has a plurality of relatively narrow internal channels therein arranged in a winding, labyrinth-like, sinuous, zigzag pattern. The channels are sized to accommodate the passage of an evaporative refrigerant, and extend substantially throughout all of the operative portion of the disc so that the liquid freezing surfaces are close to and are chilled by the refrigerant passing through the channels. Each channel has an inlet and outlet located at a central portion of the disc. The channels extend from the center towards the perimeter of the disc and then zigzag back towards the central portion. The layers of one form are complimentary mirror images and in another form are two planar outer layers encasing a layer with channels formed on each side. The channels are formed by etching, or computer controlled machining.

16 Claims, 13 Drawing Sheets

Fig.20.
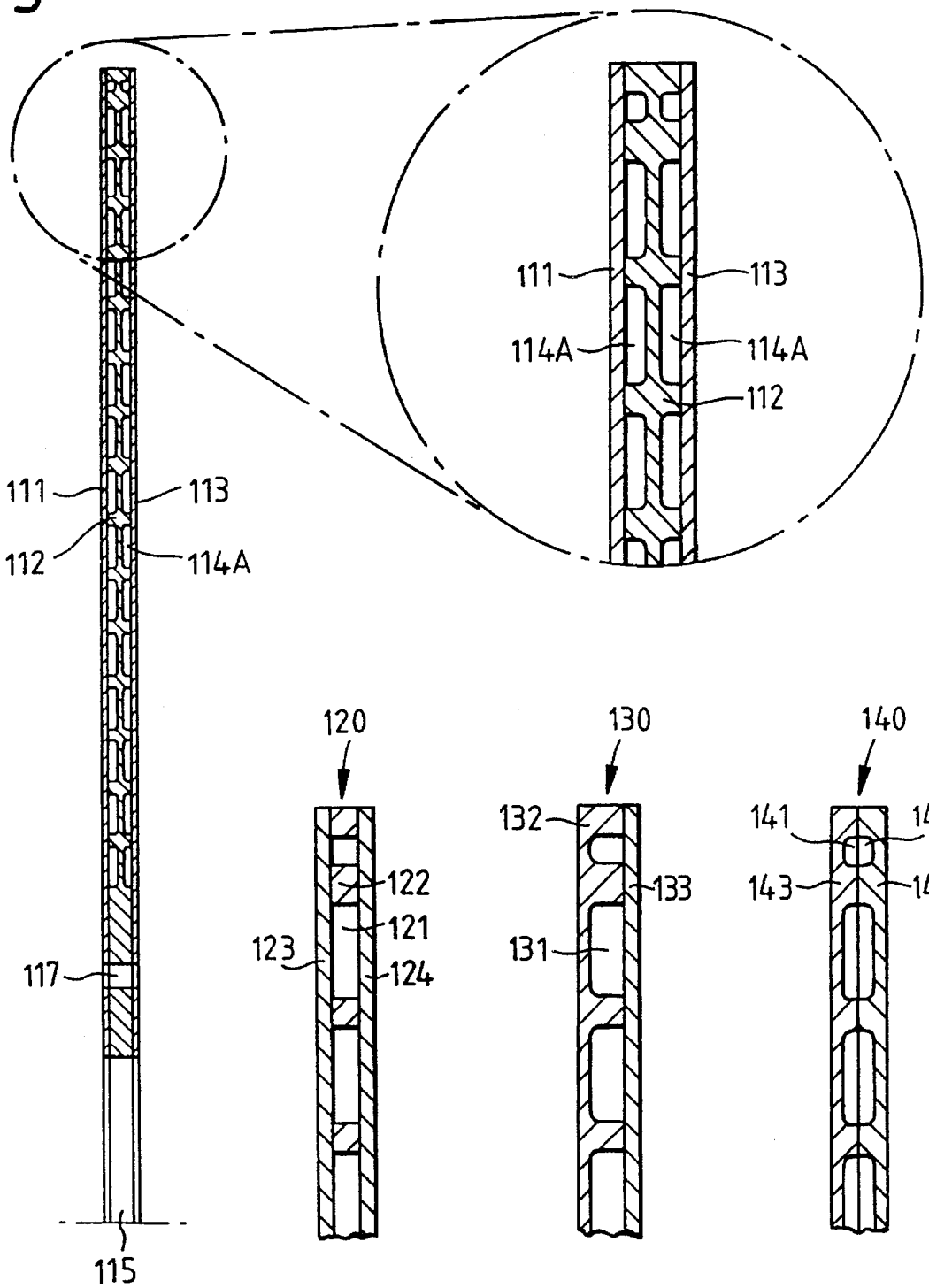
Fig.21.
Fig.22.
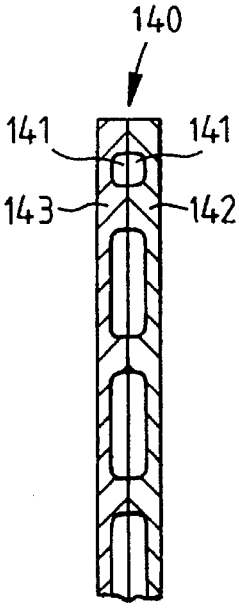
Fig.23.

ROTATABLE REFRIGERATING DISC FOR ICE MAKING APPARATUS

This application is a continuation-in-part of prior application Ser. No. 08/121,662, filed Sep. 15, 1993, now abandoned, which was a continuation of Ser. No. 07/882,842, filed May 14, 1992, now abandoned, which was a division of Ser. No. 07/458,670, filed Jul. 6, 1990 (now U.S. Pat. 5,157,939) which was a national application based upon PCT/AU88/00268, filed Jul. 31, 1988, which was based upon Application PI3458 in Australia, filed Jul. 31, 1987.

The present invention relates to ice making apparatus and in particular, the invention is directed to a rotatable refrigerating disc suitable for use in a flake ice machine.

BACKGROUND OF THE INVENTION

Flake ice is made in thin sheets approximately 1.5–6.0 mm thick. The sheets may be curved or flat and the thin ice is generally broken into random-sized flakes when harvested.

Flake ice is particularly suitable for packing products such as fish or frozen foods as the ice flakes can be packed close to the products. In other applications such as chemical processing and concrete cooling, where rapid cooling is important, flake ice is ideal because the flakes present the maximum amount of cooling surface for a given amount of ice.

Flake ice is commonly produced by the application of water to the inside or outside of a refrigerated cylindrical drum. The water is applied at a first angular location on the drum and adheres thereto in a thin layer by surface tension. As the drum rotates, the water freezes into a thin layer of ice, which is fractured by an ice removal device at a second angular location downstream from the first angular location in the direction of rotation.

The thickness of the flake ice can be varied by adjusting the speed of the rotating drum, varying the evaporator temperature, and regulating the water flow on to the freezing surface. Since flake ice can be made in a continuous operation without being interrupted for a harvest cycle, less refrigeration tonnage is required to produce a tonne of ice than any other type of manufactured ice when similar make up water and evaporating temperatures are compared.

In known machines, water is applied to only one side of the drum, i.e., either the outside or inside, but not both. As a result, the refrigerated surface on the other side of the drum is unused, and the ice making operation represents an inefficient use of the refrigeration capacity of the machine.

Furthermore, as the ice removal device is located only on the side of the drum on which ice is formed, the continual unbalanced force applied to that side of the drum to fracture the ice from the freezing surface accelerates the wear on the drum bearings.

A further disadvantage of known ice making machines of the drum type is that their capacity cannot be readily increased. If increased capacity is desired, it is usually necessary to install a whole new machine. That is, in addition to installing an extra refrigerated drum, it is also necessary to install another refrigeration unit including motor, compressor and condenser, and a new drive unit. Any upgrading in capacity will therefore involve considerable expense.

U.S. Pat. No. 3,863,462 (Treuer) describes a machine for making flake ice by applying water to both sides of a rotating refrigerated disc. The water is applied by spray application and a thin layer of water adheres to the disc surfaces by surface adhesion. As the disc rotates, the water freezes to form a layer of ice, which is then dislodged from the disc surfaces by scraper blades or other means.

The flake ice machine of U.S. Pat. No. 3,863,462 has an upright refrigerated disc rotatable on a horizontal shaft. The disc is approximately 1.8m in diameter and comprises a pair of large round aluminum plates spaced apart about 20mm and sealed at their periphery to form an enclosed space. Baffles are placed within the interior of the disc to form rudimentary passages through which a chilled coolant is pumped. Due to the large flow passages inside the Treuer disc, it is necessary to use a non-evaporative or non-"boiling" refrigerant, such as brine or glycol.

As the coolant must remain liquid, it cannot be chilled below its freezing point, and hence its heat absorption capacity is limited. Due to the limited thermal capacity of the chilled coolant system, a relatively large amount of coolant must be pumped through the disc thereby requiring significant pumping capacity.

In addition, a separate refrigeration plant is required to chill the coolant before it is pumped through the disc. The Treuer machine therefore involves double heat transfer, namely first chilling the coolant, and then using the coolant to chill the surfaces of the disc. Inefficiencies and losses are introduced with each thermal transfer.

It is an object of the present invention to overcome or ameliorate at least some of the above-described disadvantages of the prior art by providing an improved ice making machine having at least one highly efficient rotatable, refrigerant disc configured internally to accommodate an evaporative refrigerant.

It is another object of the present invention to provide an improved refrigerated disc for use with the ice making machine.

SUMMARY OF THE INVENTION

The invention comprises a refrigerating disc suitable for use in an ice making machine, such as the flake ice machine employing an evaporative refrigerant. The disc is of planar form and has liquid freezing surfaces on both sides thereof. The disc is of laminated construction comprising at least two layers bonded together, and has a plurality of relatively narrow internal channels therein preferably arranged in a winding, labyrinth-like, sinuous, zigzag pattern. The channels are sized to accommodate the passage of an evaporative refrigerant, and extend substantially throughout all of the operative portion of the disc so that the liquid freezing surfaces are close to and are chilled by the refrigerant passing through the channels. Each channel has an inlet and outlet located at a central portion of the disc. The channels extend from the centre towards the perimeter of the disc and then zigzag back towards the central portion.

Preferably, the channels are of the same equivalent length, i.e., the pressure drop in the refrigerant between the inlet and the outlet of each channel is substantially the same for all channels.

In one embodiment, the disc comprises two outer layers having plane surfaces and a third layer sandwiched between the two outer layers, the third layer having open channels formed on both sides thereof which, when the layers are bonded together, form the internal channels between the third (middle) layer and a respective one of the outer layers. The open channels may be formed by etching or milling.

In another embodiment, the laminated disc comprises two outer layers having plane surfaces and a third layer sandwiched between the two outer layers, the third (middle) layer having slots or through channels formed therein which, when the layers are bonded together, form the internal channels between the two outer layers. The through channels can be formed by laser cutting or routing.

In yet another embodiment, the laminated disc comprises two layers bonded together, at least one of the layers having open channels formed therein which, when the layers are bonded together, form the internal channels between the two layers. The open channels may be formed in one layer which is then bonded to a plane layer. Alternatively, channels may be formed in two layers in patterns which are mirror images of each other, the two layers being bonded together such that the patterns are aligned and the open channels form the internal channels between the two layers.

As alluded to above, ice making apparatus including the discs disclosed herein is able to utilize direct expansion refrigeration with a "boiling" or evaporative refrigerant thereby enabling higher efficiency and freezing capacity to be achieved. Only one refrigeration system is required, the disc(s) itself constituting the evaporator of the refrigeration system.

In a single disc machine, the refrigerated disc has a central aperture having a collar fitted therein. On one side, the collar receives a hollow shaft delivering the compressed refrigerant. The collar has a series of radial bores, communicating at their inner ends with the hollow shaft. At their outer ends, the radial bores communicate with respective inlets to the channels extending through the disc, the channel inlets being located on the cylindrical surface of the disc aperture. The liquid refrigerant passes through the hollow shaft and into the internal channels of the disc whereat it evaporates to thereby cool the disc.

The channel outlets communicate with another hollow shaft on the opposite side of the collar via a second set of radial bores in the collar. The evaporated refrigerant is extracted through this hollow shaft to the compressor. The disc, collar and shafts form a single assembly which is rotated by a motor using a belt or chain drive to a pulley or sprocket on one of the shafts.

However, the disc can be rotated in any other suitable manner. For example, the disc can be provided with a toothed perimeter so that the disc can be driven by a cogwheel gear, either directly or chain-driven.

In a multiple disc machine, a number of discs are mounted on a common shaft and refrigerant is fed to the channels in each disc via a distributer and pipe lead system. The discs are fed in parallel, and the lengths of the pipe leads are made substantially equal to ensure equal pressure drop in the refrigerant feed to the discs. The evaporated refrigerant can be extracted via the common hollow shaft.

Preferred embodiments of the invention will now be described by way of example with reference to the accompanying drawings.

BRIEF DESCRIPTION OF THE DRAWINGS

FIG. 20 is a sectional view of part of the disc of FIG. 18, FIG. 21 is a radial sectional view of part of a disc according to yet another embodiment of the invention, FIG. 22 is a radial sectional view of part of a disc according to a further embodiment of the invention, FIG. 23 is a radial sectional view of part of a disc according to a still further embodiment of the invention.

DESCRIPTION OF THE PREFERRED EMBODIMENTS

Figure 1:
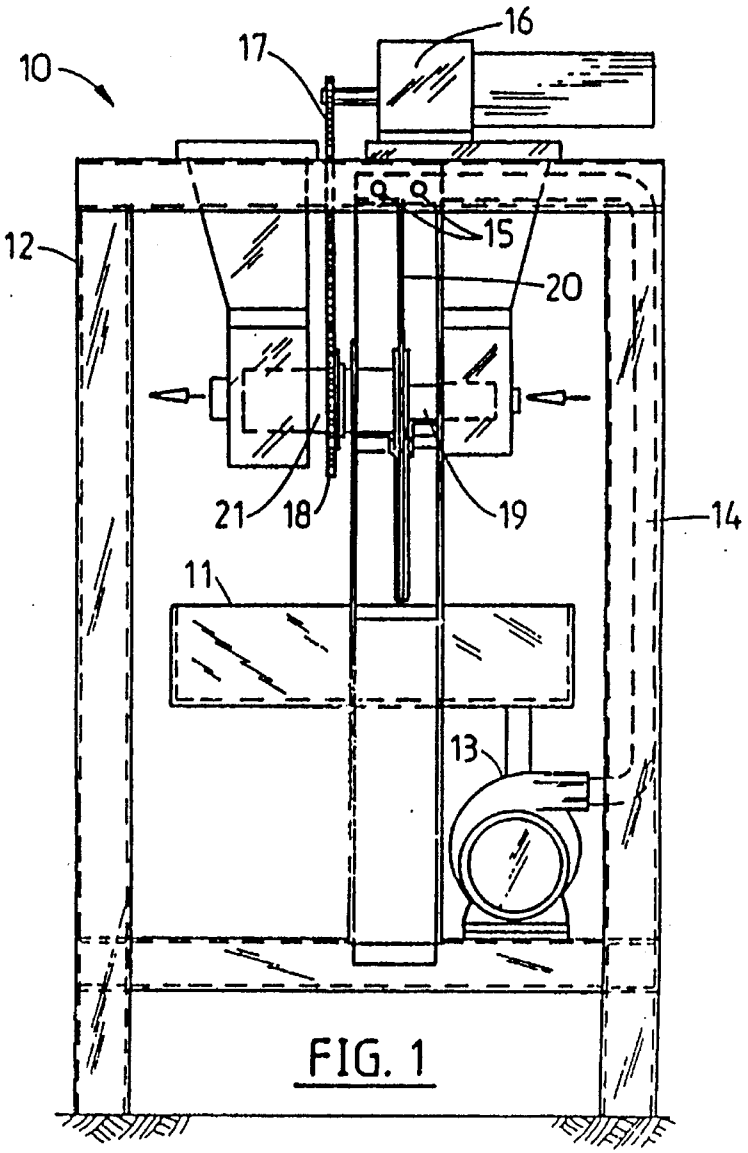
FIG. 1 is a side elevational view of an ice making apparatus including the disc of the invention.
Figure 2:
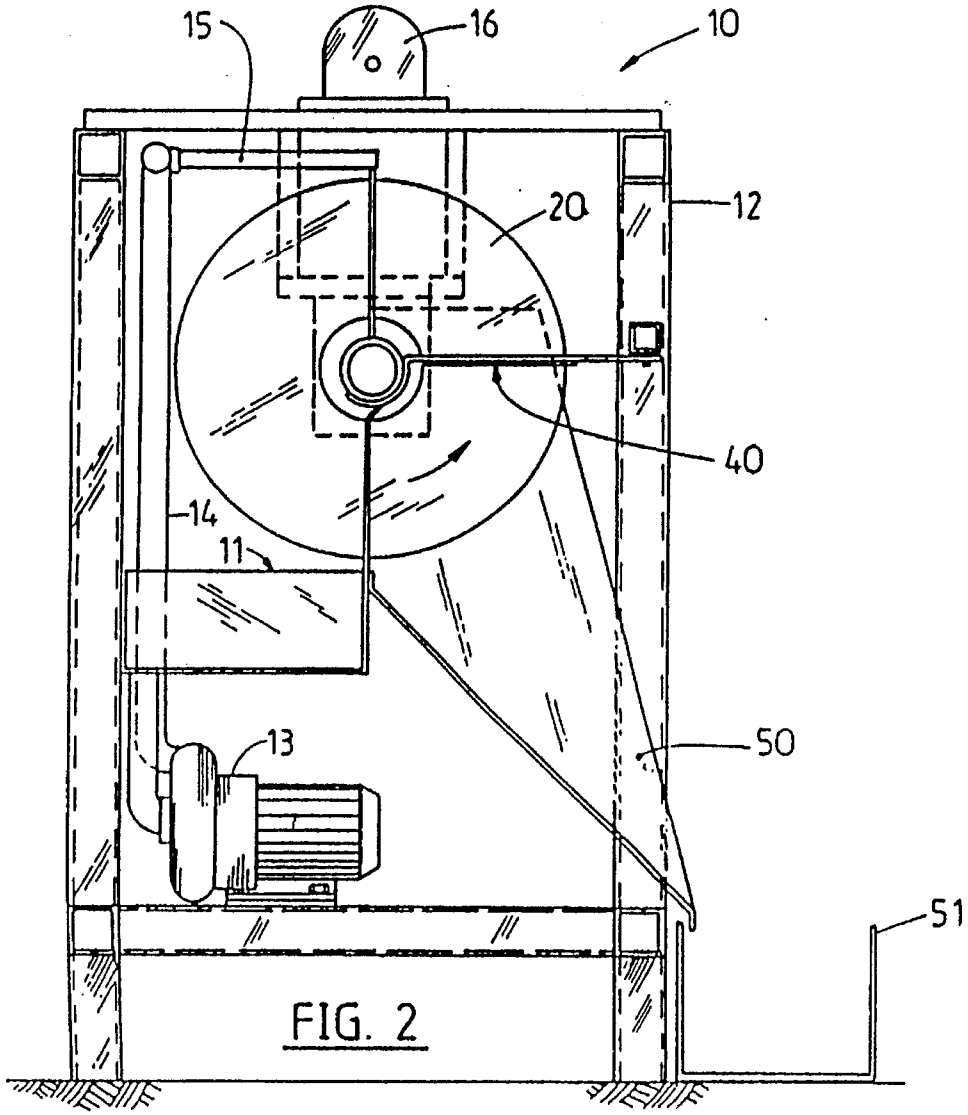
FIG. 2 is a sectional elevational view along A—A of FIG. 1.

As shown in the FIGS. 1 and 2, the ice making machine 10 which incorporates the invention comprises a frame 12 on which are mounted a water reservoir 11 and a pump 13. Water from the reservoir 11 is pumped by pump 13 through upwardly extending pipe 14 to a pair of water sprays 15 located above and on respective sides of a rotating refrigerated disc 20. The water sprays are oriented to direct water onto both surfaces of the disc to thereby leave a film of water adhering to both disc surfaces. The disc 20 rotates in the direction indicated by the arrow in FIG. 1 and is driven by a motor 16 via a belt or chain 17 and pulley 18. However, the disc 20 may be rotated by any other suitable means. For example, the disc 20 may be provided with a toothed perimeter and driven by a cog-wheel gear either directly or by chain.

The refrigerated disc 20 has a plurality of channels therein and constitutes the evaporator in a refrigeration circuit. The mounting of the refrigerated disc 20 is shown in more detail in FIG. 3. As can be seen in that drawing, the disc 20 has a central circular aperture having a circular collar 22 inserted therein. On one side, the collar 22 receives a hollow shaft 18 delivering refrigerant while on its other side, the collar 22 receives another hollow shaft 21 for removing the evaporated refrigerant. The shafts 18, 21, collar 22 and disc 20 are fixed relative to each other and rotate as a single assembly. To enable rotation, shaft 18 is mounted in a bearing structure 25 while shaft 21 is mounted in a bearing structure 23. The bearings 23, 25 are located in respective bearing blocks which preferably are adjustably and removably mounted within the frame 12 of the ice making machine. Hollow shafts 18 and 21 communicate respectively with the condenser and compressor (not shown) of a refrigeration circuit. 0-rings 26, 24 or other suitable sealing elements are provided to seal the connections to the shafts 18, 21 respectively.

The shaft 21 has attached thereto a pulley, sprocket or cog 18 which is rotated by the motor 16 via a belt or a chain 17. Rotation of the pulley 18 in turn rotates the disc/collar/pipe assembly.

Figure 4:
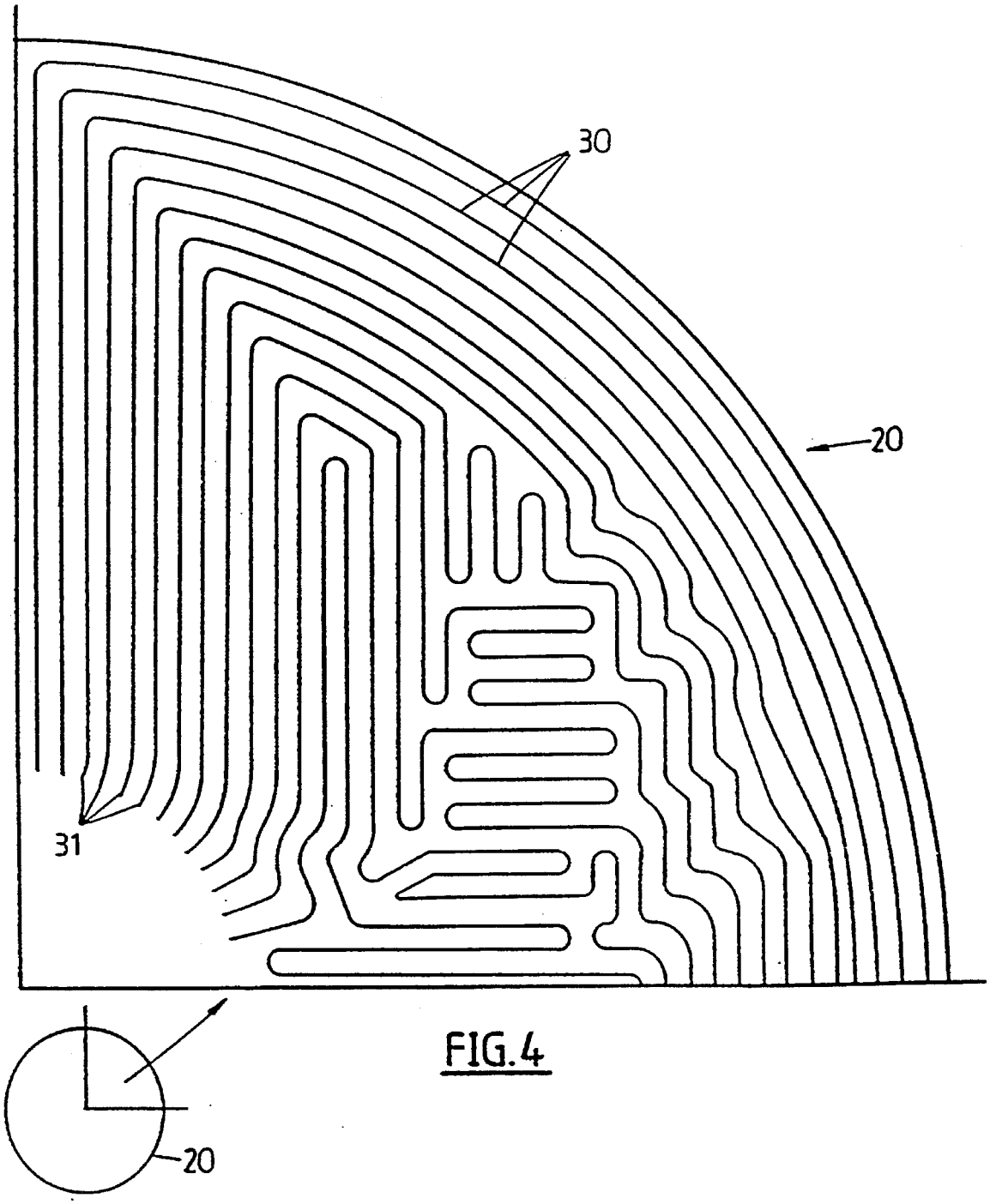
FIG. 4 is a sectional view of a quadrant of the disc of the ice making apparatus of FIG. 1.
Figure 5:
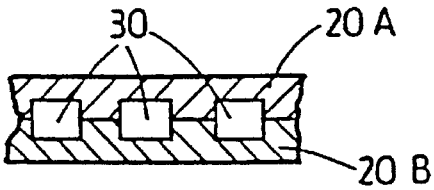
FIG. 5 is a sectional view of part of the disc of FIG. 4.
Figure 6:
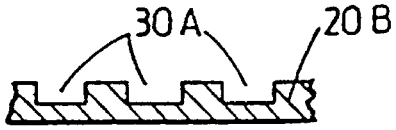
FIG. 6 is a sectional view of part of one half disc of FIG. 4.

The refrigerated disc 20 is shown in more detail in FIGS. 4–6. The disc 20 is of laminated construction and comprises two discs 20A and 20B sandwiched together. Each disc 20A, 20B has a pattern of open channels 30A formed in a surface thereof, for example by etching or machining. The channel patterns are mirror images of each other so that when the discs 20A and 20B are bonded together, closed channels 30 are formed. The disc is typically 4–10 mm thick, and the channels are typically 3.5 mm wide ×2.5 mm high, ideal for utilization of an evaporative refrigerant but rather incompatible with the use of a liquid refrigerant.

The channel pattern for a quadrant of the disc 20 is shown in FIG. 4. The pattern for the bottom right quadrant is the inverse to the illustrated pattern for the top right quadrant, and the patterns for the top and bottom left quadrants are mirror images of the patterns for the top and bottom right quadrants, respectively. The channel pattern is so designed that (a) the channels are spread over substantially the whole operative surface of the disc so that all points on the surface are close to the refrigerant, and (b) the channels are of substantially equal length so that there is a uniform pressure drop in the refrigerant in all the channels.

These two features ensure that the disc is refrigerated as uniformly and evenly as possible. Moreover, the provision of a pattern of thin channels enables the disc to be refrigerated using an evaporative or "boiling" refrigerant as opposed to brine. Faster and more efficient cooling of the disc is therefore obtained.

Although the illustrated disc is composed of two layers, more than two layers can be used to form the laminated disc as described fully below.

Each channel 30 has an inlet 31 communicating with the central aperture in the disc. The outlets of the channels 30 are also located on the inner cylindrical surface of the disc, on the opposite side to the inlets.

Figure 3:
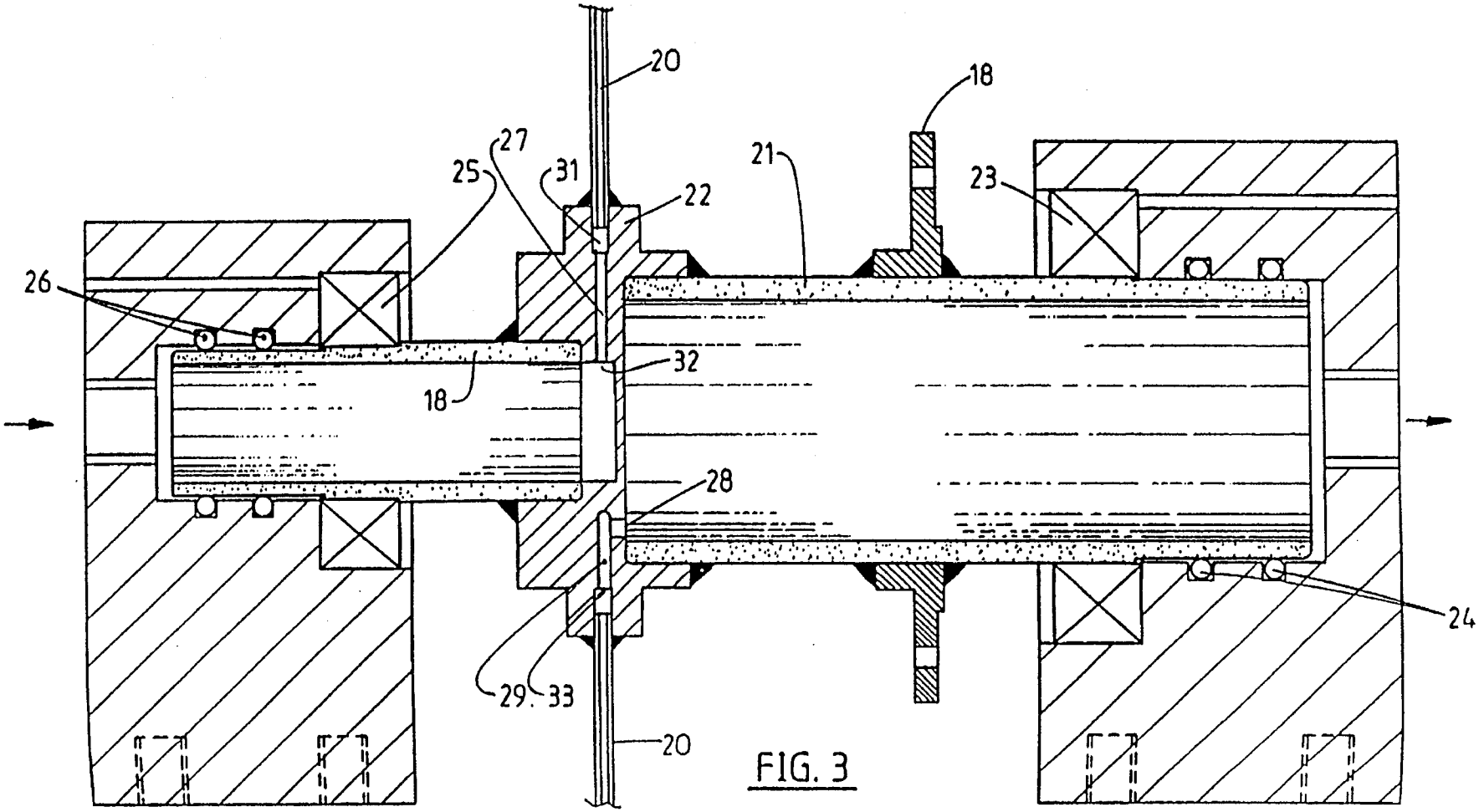
FIG. 3 is a sectional side elevational view of the disc mounting arrangement of FIG. 1.
Figure 8:
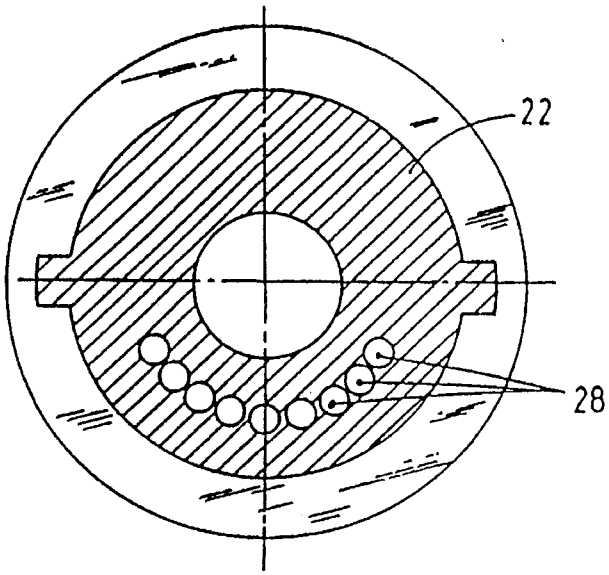
FIG. 8 is a sectional elevational view along C—C of FIG. 3.
Figure 7:
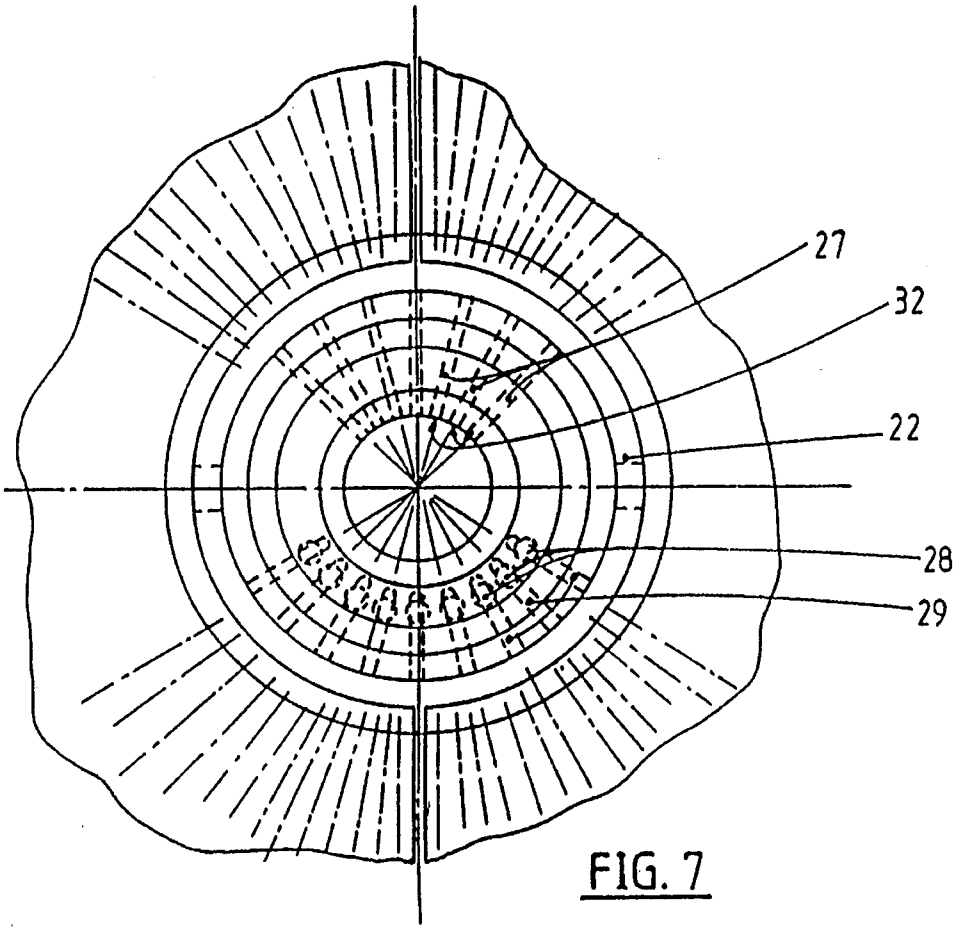
FIG. 7 is a sectional elevational view along B—B of FIG. 3.

As shown in FIGS. 3, 7 and 8, the collar 22 has a plurality of radial bores 27 on one half which communicate at their inner ends 32 with the hollow shaft 18 and at their outer ends with the inlets 31 of the channels 30 in the disc 20. On the opposite half, the collar 22 is provided with a plurality of radial bores 29 having outer ends communicating with the outlets 33 of channels 30 and inner ends communicating with axial bores 28 which, in turn, communicate with the hollow shaft 21.

Condensed liquid refrigerant is fed via shaft 18 through radial bores 27 in the collar 22 and into the channels 30 in the disc 20 where it evaporates, transforming into the gaseous phase, to cool the disc. The evaporated refrigerant is drawn from the channel outlets 33 through bores 20 and 28 and out through the hollow shaft 21 to the compressor (not shown) in the refrigeration circuit. In this manner, the disc acts as the evaporator in the refrigeration circuit.

As shown in FIG. 2, ice removal means 40 are mounted on frame 12 for fracturing the ice formed on the disc from the refrigerated surfaces. After being broken off the disc, the ice falls down chute 50 to be collected in ice bin 51.

Figure 9:
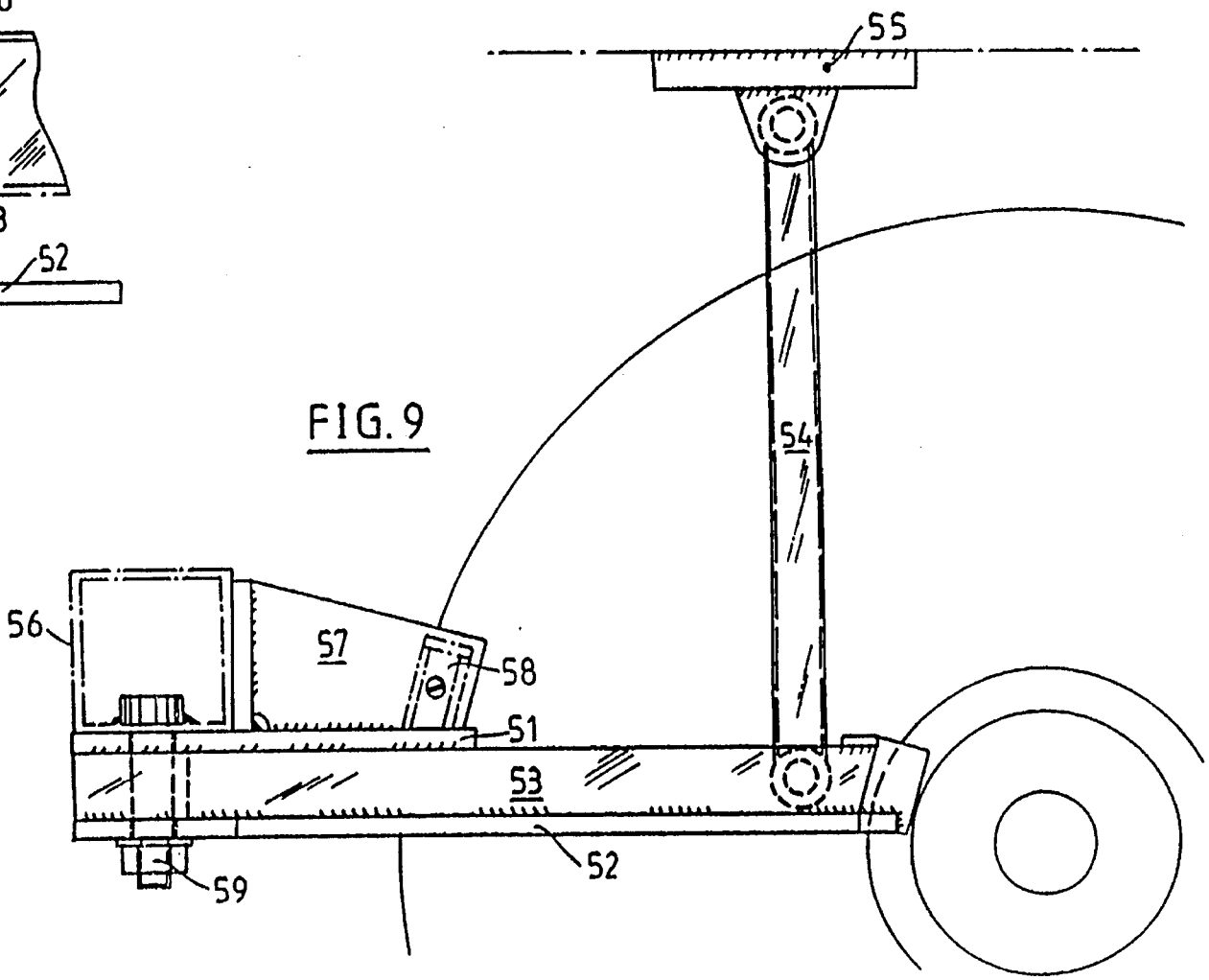
FIG. 9 is an elevational view of the ice removal means of FIG. 2.
Figure 10:
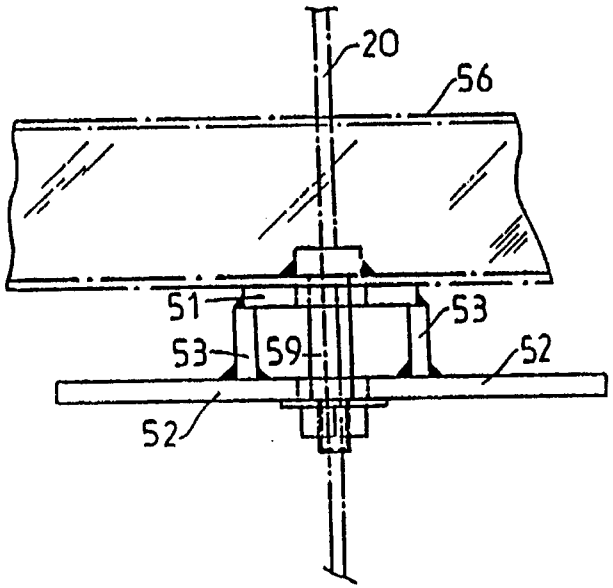
FIG. 10 is an end elevational view of the ice removal means of FIG. 9.
Figure 11:
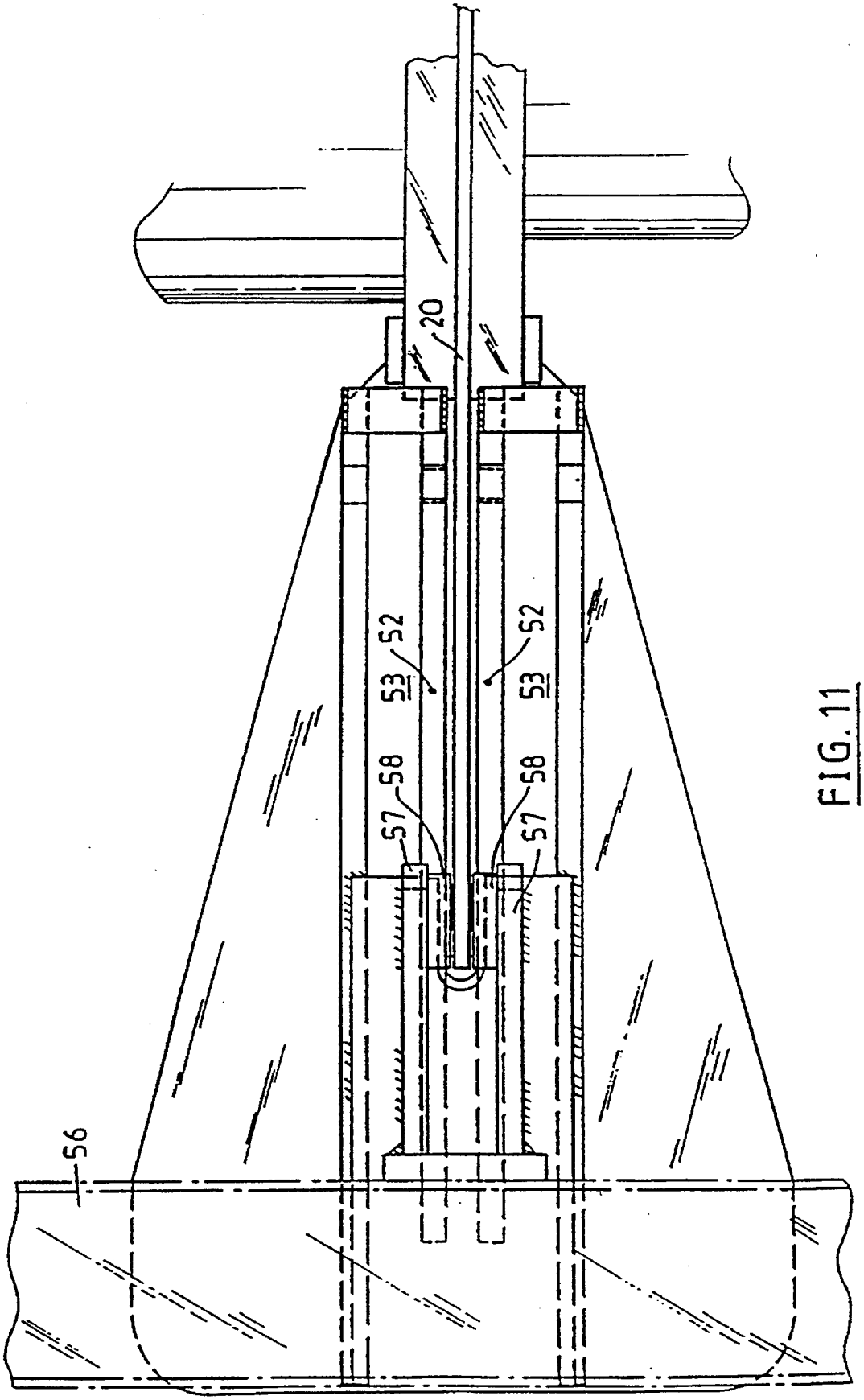
FIG. 11 is a plan view of the ice removal means of FIG. 9.

An embodiment of a harvesting blade assembly is shown in FIGS. 9–11. In this embodiment, harvesting blades 52 are fixed to the bottom edge of a respective one of a pair of radial arm members 53 which in turn are fixed to a support plate 51 which is fastened by a bolt 59 to a cross beam 56 in the frame 12 of the ice making machine. The inner ends of the arms 53 are supported by a pendant arm 54 which is pivotally attached to a bracket 55 on the machine frame. As this mounting arrangement is supported by the main frame rather than the shafts 18, 21, it eliminates pressure on the bearings 23 and 25 and prolongs the life of such bearings.

The harvesting blade assembly shown in FIGS. 9–11 also comprises a bearing block 58 held between a pair of brackets 57 to maintain correct relative alignment between the disc 20 and the working edges of the harvesting blades 52.

The harvesting blade assembly is of simple economic construction yet is easy to adjust and to maintain.

Moreover, the harvesting blade assembly harvests the ice on both sides of the disc 20 at the same angular location so that the forces on the disc are balanced.

Since ice is formed on both sides of the disc 20, the ice making machine can be made more compact than known drum machines in which ice is formed on only one side of the drum. Moreover, as the freezing surfaces of the disc are in close proximity to the refrigerant, greater efficiency is achieved. The ice making machine has few moving parts, thereby requiring less maintenance than existing machines. In the event that maintenance is required, the disc/shaft/bearing assembly shown in FIG. 3 can easily be removed from the bearing mounts in the machine.

The machine can be started and stopped intermittently and the speed of the disc can be varied to produce products of different clarity and consistency. A single 500 mm diameter disc can produce over half a tonne of ice in a twenty-four hour period.

Figure 12:
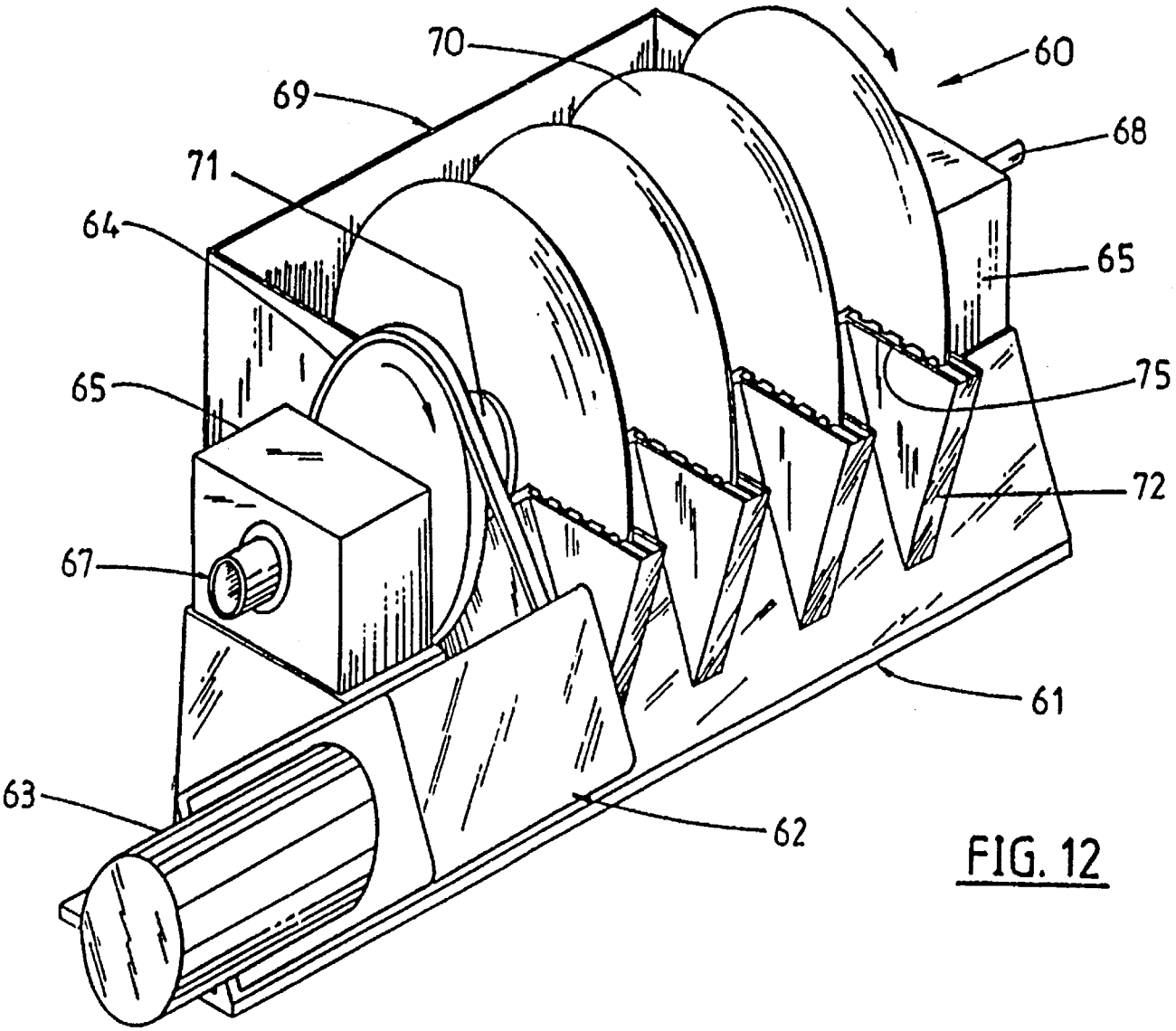
FIG. 12 is a perspective view of a multiple disc ice making apparatus according to another embodiment.
Figure 13:
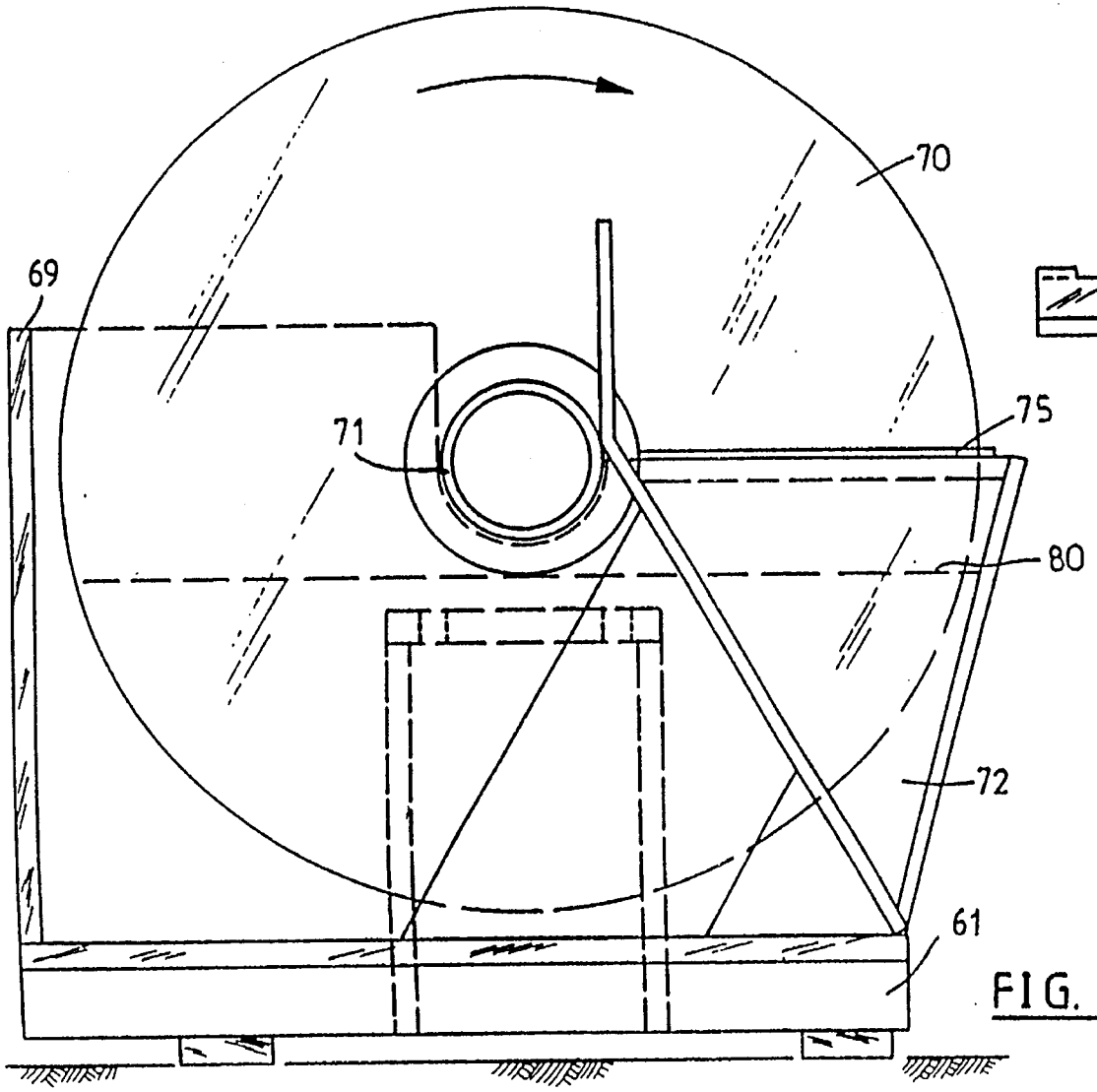
FIG. 13 is a sectional view of the multiple disc machine of FIG. 12.

Another embodiment showing the usefulness of the discs of the present invention is illustrated in FIGS. 12 to 17, this construction utilizing a plurality of refrigerated discs. As shown in FIGS. 12 and 13, the multi-disc ice making machine of the invention comprises a number of refrigerated discs 70 mounted on a common hollow shaft 71. The shaft 71 is mounted at its ends on combined bearing and seal assemblies 65. An inlet port 68 is provided at one end of the hollow shaft 71 for connection to a source of condensed liquid refrigerant, while the opposite end of the shaft 71 has an outlet port 67 for a suction connection for the evaporated refrigerant. The discs 70 constitute the evaporator of a refrigeration circuit in a similar manner to the embodiment of FIGS. 1 to 11.

The discs 70 are mounted in a water tank 69, which typically is made of stainless steel or glass reinforced plastic. The tank 69 is mounted on a base 61, which is suitably made of cast aluminum alloy. Spaced pairs of flanges 72 are formed on the tank 69, each disc 70 passing between a respective pair of flanges 72. Scraper blades 75 are provided at the top of respective flanges 72 for fracturing the ice sheet formed on the discs 70 as the discs rotate past the blades.

The discs 70 and shaft 71 are rotated by a pulley or sprocket 64 coaxially mounted on the shaft 71 and driven, by chain or belt, by a drive motor 63 via a reduction gear box 62. However, it will be apparent to those skilled in the art that other means of rotating the discs 70 may be provided. For example, the pulley or sprocket 64, or one or more of the discs 70, may be provided with a toothed circumference and driven directly by a cog-wheel gear.

The tank 69 is filled with water to the level 80 as indicated in FIG. 13. As the disc 70 moves through the water in the tank 69, a film of water will adhere to both surfaces of the disc due to surface tension. As the refrigerated disc 70 rotates in the clockwise direction as shown, the water adhering to the refrigerated surfaces of the disc will freeze to form a thin sheet of ice which is subsequently fractured from the disc surface by the scraper blades 75 positioned as shown. Any water not adhering to the surface of the disc 70 or not being frozen will simply trickle back into the tank 69. Accordingly, there is little wastage of the liquid to be frozen.

Ice production can be increased by reducing the temperature of water in the tank 69 to close to the freezing point, increasing the speed of rotation of disc 70 and increasing the flow of the evaporative refrigerant through the disc 70.

The design and construction of each refrigerated disc is substantially as hereinbefore described with reference to FIGS. 4–6.

Figure 14:
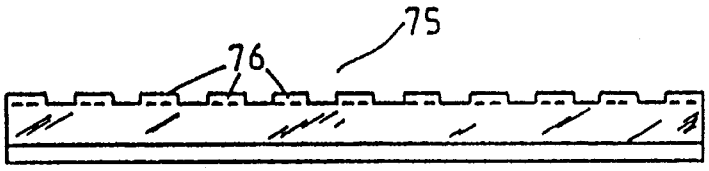
FIG. 14 is a plan view of the ice removal means of FIG. 12.
Figure 15:
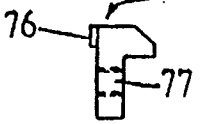
FIG. 15 is a side view of the ice removal means of FIG. 14.

An exemplary form of the scraper blade is illustrated in FIGS. 14 and 15. Each scraper blade 75 is removably mounted on top of its respective flange 72 by suitable fasteners through holes 77. Each scraper blade 75 comprises a series of teeth 76 for fracturing the sheet ice from the refrigerated surfaces of the discs 70. The scraper blades are hardened and tempered to resist wear. The only substantial wear in the machine is the abrasion of the ice against the scraper blades, and the scraper blades 75 can easily be removed for replacement and/or resharpening.

Figure 16:
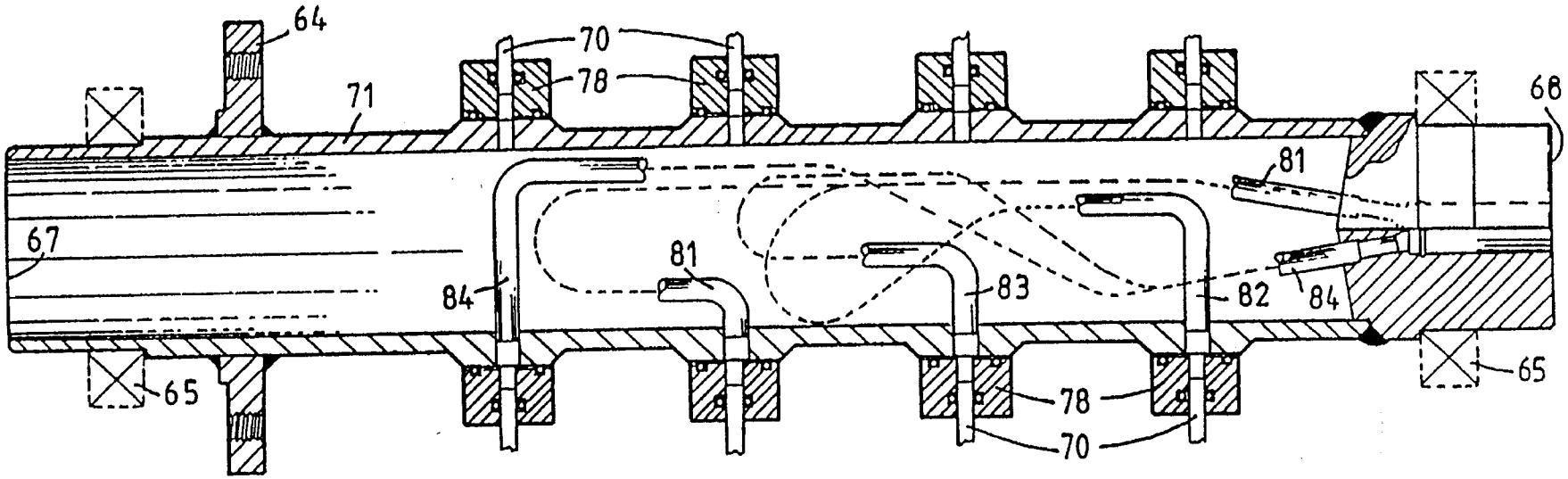
FIG. 16 is a sectional view of the shaft of FIG. 12.
Figure 17:
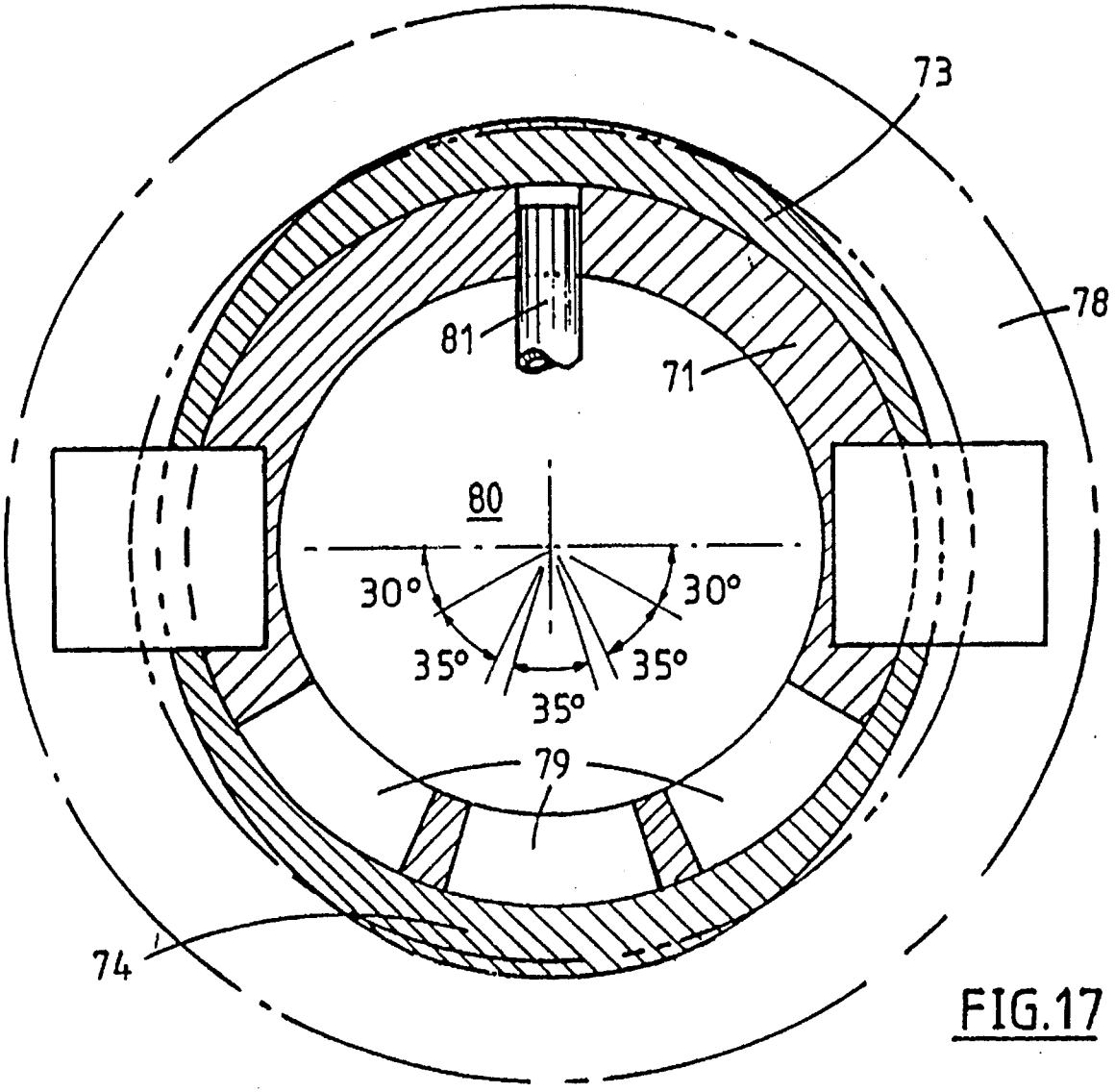
FIG. 17 is a sectional view of the disc mounting on the shaft of FIG. 16.
Figure 18:
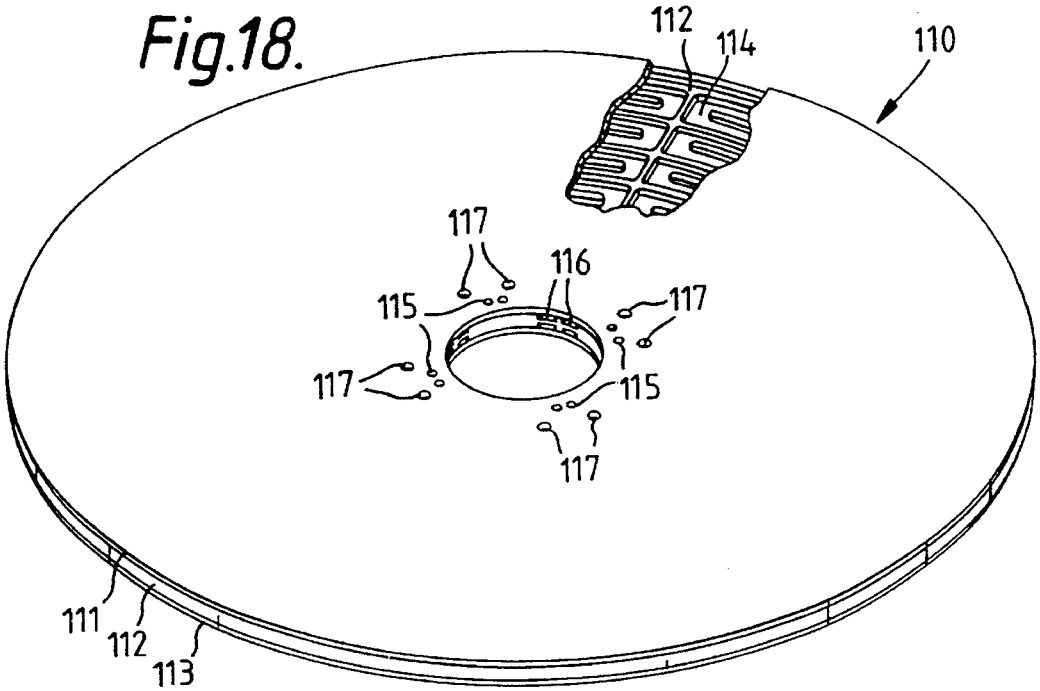
FIG. 18 is a partially cut-away perspective view of a disc according to another embodiment of the invention.
Figure 19:
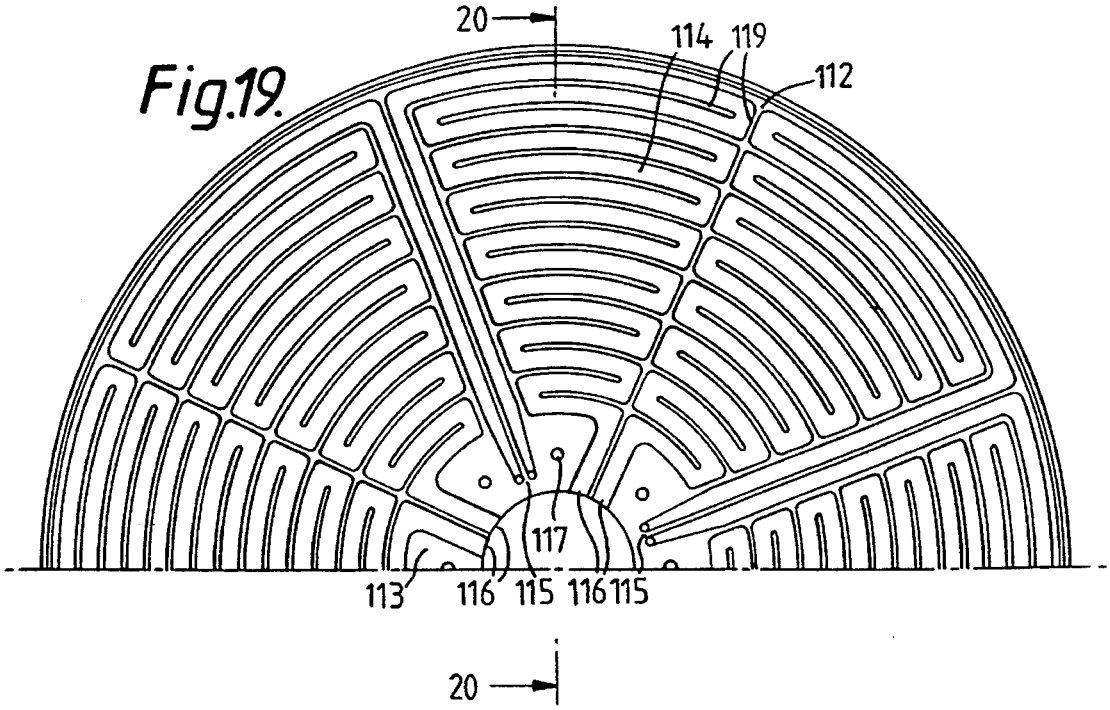
FIG. 19 is a plan view of the disc of FIG. 18, with its top layer removed.

The feeding of refrigerant to the discs 70 is illustrated in FIGS. 16 and 17. A four-way liquid refrigerant distributor is provided at the inlet port 68 of the hollow shaft 71. The four-way distributor comprises four copper distributor tubes 81–84 which communicate with the channels in the respective discs 70. The lengths of the distributor tubes 81–84 from the inlet port 68 to their respective discs 70 are made equal in order to obtain equal pressure drop in the refrigerant feed to each disc.

The delivery end of each distributor tube 81–84 is received in a radial bore in a respective collared portion of the hollow shaft 71 on which an associated disc 70 is mounted. Each disc 70 is mounted to a collared portion by means of a clamping ring-nut 78. An internal elliptical bore is formed in the centre of each clamping ring-nut 78 to provide an inlet chamber 73 between the delivery end of the respective delivery tube 81–84 and the channels in the associated disk. Refrigerant delivered through tubes 81–84 fills the receptive chambers 73 which communicate with the channel openings 31 of each respective disc 70. Refrigerant flows through the channels 30 of each respective disc whereat it is evaporated to cool the discs. The evaporated refrigerant is extracted via the channel outlets which communicate with a suction chamber 74 formed between the shafts 71 and the disc 70 by the elliptical aperture in the clamping ring-nut 78. The suction chamber 74, in turn, communicates with the interior of the hollow shaft 71 via slots 79 cut into the shaft 71. The refrigerant is extracted from the interior 80 of the hollow shaft 71 via the outlet port 67 for delivery to the compressor of the refrigeration circuit.

In another preferred embodiment, illustrated in FIGS. 18–21, a laminated refrigerating disc 110 comprises outer planar annular layers or "plates" 111, 113, and a profiled plate 112 sandwiched therebetween. Relatively narrow open channels 114 are formed in a predetermined pattern on both sides of the middle plate 112 such that when plate 112 is sandwiched between outer plates 111, 113, closed channels 114A are formed between both sides of the middle plate 112 and respective outer plates 111, 113.

The open channels 114 in the centre plate 112 can be formed by chemically etching the channels 114 into the faces of centre plate 112. Alternatively, open channels 114 can be milled in the plate 112 using a computer controlled milling machine. Other suitable methods may be used.

The three layers 111, 112, 113 of the disc 110 are bonded together and hermetically sealed. Suitable methods of bonding the sheets together include: brazing, such as vacuum brazing or brazing in an inert atmosphere; soldering, such as dip soldering or furnace soldering; and adhesive bonding. In a preferred method, a very thin layer of brazing material is interposed between plates 111, 112, 113. The plates are heated while pressed tightly together to cause the brazing layers to fuse and bond the plates together.

The plates 111, 112,113 may suitably be formed of aluminum or aluminum alloy, stainless steel, or any other suitable material. In one preferred embodiment, all plates are made of aluminum alloy. The aluminum plates may be hard anodized or plated, for example with nickel or modified nickel plating. The plane outer plates 111, 113 are formed of stainless steel, while the centre plate 112 is formed of mild steel.

Each closed channel 114A has an inlet formed by an axial opening 115 in its adjacent outer plate 111, 113. The channel 114A extends radially outwardly to the periphery or edge of the disc, and then meanders in a winding, labyrinth-like, sinuous, zigzag pattern to the center portion of the disc to communicate with an outlet 116, a radial opening which communicates with an aperture at the center of the disc 110. The serpentine path or pattern through which the refrigerant flows in the channels 114A includes a large number of path reversals or hair pin turns, fourteen being illustrated in the drawings where eight individual channels are shown on the disc 110. This arrangement affords a maximally long path, given the space available on the disc 110, for the evaporative refrigerant to traverse while transforming from the liquid to the vapor phase and absorbing heat from and causing freezing of the liquid applied to the surfaces of the disc in the process. Alternatively, in certain applications it may be desirable to establish the refrigerant inlets 115 at the radial inward portion of the serpentine pattern of the channels 114A and form the outlets 116 at the ends of the radial extending portions of the channels.

The channels 114A are so shaped and configured as to cover substantially all of the operative portions of the disc 110. In this manner, all portions of the outer plates 111, 112 on which ice is to be formed are close to the channels 114A.

The channels 114A are also shaped and configured to have the same "equivalent length", i.e., the pressure drop experienced by refrigerant passing through the channels is substantially the same for all channels.

To ensure uniform cooling of the disc 110, the refrigerant pressure drop between the inlet and outlet of each channel should be kept as low as possible. However, internal heat transfer is proportional to the pressure drop. Channel design therefore involves a balance between good internal heat transfer and uniformity of disc surface temperature.

Similarly, the design of the lands 119 defining the channel boundaries involves a balance between structural strength considerations and thermodynamic considerations. The lands 119 should be narrow so that all portions of the outer plates 111, 113 are close to the refrigerant, yet the lands should be wide enough to provide sufficient stiffening of the outer plates to ensure that they maintain their planar form, and to provide sufficient bonding area to withstand internal pressures.

Each closed channel 114A is of relatively small cross sectional area, typically 20–40 $mm^2$, ideal for an evaporative refrigerant but unsuitable for a non-evaporative fluid such as brine or glycol. The disc 110 can therefore be used as an evaporator in a refrigeration circuit. Evaporative or "boiling" refrigerant is introduced into inlets 115 and passes through the channels 114A to the outlets 116 which are at lower pressure. The refrigerant evaporates, either wholly or partially, within the channels 114A and thereby absorbs heat. In this manner, the outer plates 111, 113 are directly cooled by the refrigerant passing through the channels 114A.

The disc 110 may be mounted between two collars, each of which is mounted on a respective hollow shaft, the shafts being concentrically mounted. Through holes 117 are provided in the disc 110 to enable it to be securely held between the collars. The refrigerant is passed through one hollow shaft and into the axial inlets 115 which communicate with the hollow shaft. After passing through the channels 114A and being wholly or partially evaporated, the refrigerant passes through channel outlets 116 to the interior of the other shaft on the other side of the disc.

In another application, a plurality of discs 110 may be mounted in a multidisc machine as described above.

In an alternative embodiment, illustrated in FIG. 21, a laminated disc 120 is formed by bonding three plates together. The disc is constructed by first forming slots or through channels 121 in a plate 122. The through channels 121 are preferably formed by laser cutting, or by routing using a computer controlled routing machine. Once the channels 121 have been formed in the plate 122, it is sandwiched between two plane outer plates 123, 124. The plates are then bonded together, as described above to form a disc having a plurality of narrow internal channels as shown in FIG. 21. The channels 121 may have the same pattern as channels 14 in FIG. 19.

In a further embodiment, illustrated in FIG. 22, a disc 130 is formed from two plates. Open channels 131 are formed in one plate 132, preferably by chemical etching, or milling using a computer controlled milling machine. The plate 132 is then bonded, as described above, to a flat plate 133 to form the disc 130.

In yet another embodiment, illustrated in FIG. 23, open channels 141 are formed in plates 142, 143, preferably by etching. The channels are formed in patterns on the respective plates 142, 143 which are mirror images of each other. The plates 142,143 are then bonded together to form disc 140, the open channels in each plate forming composite closed channels as shown in FIG. 23.

The outer plate surfaces on each disc may be coated with a release coating to facilitate removal of ice formed thereon, yet still retain water in liquid form on the surfaces to enable the flake ice to form.

Figure 24:
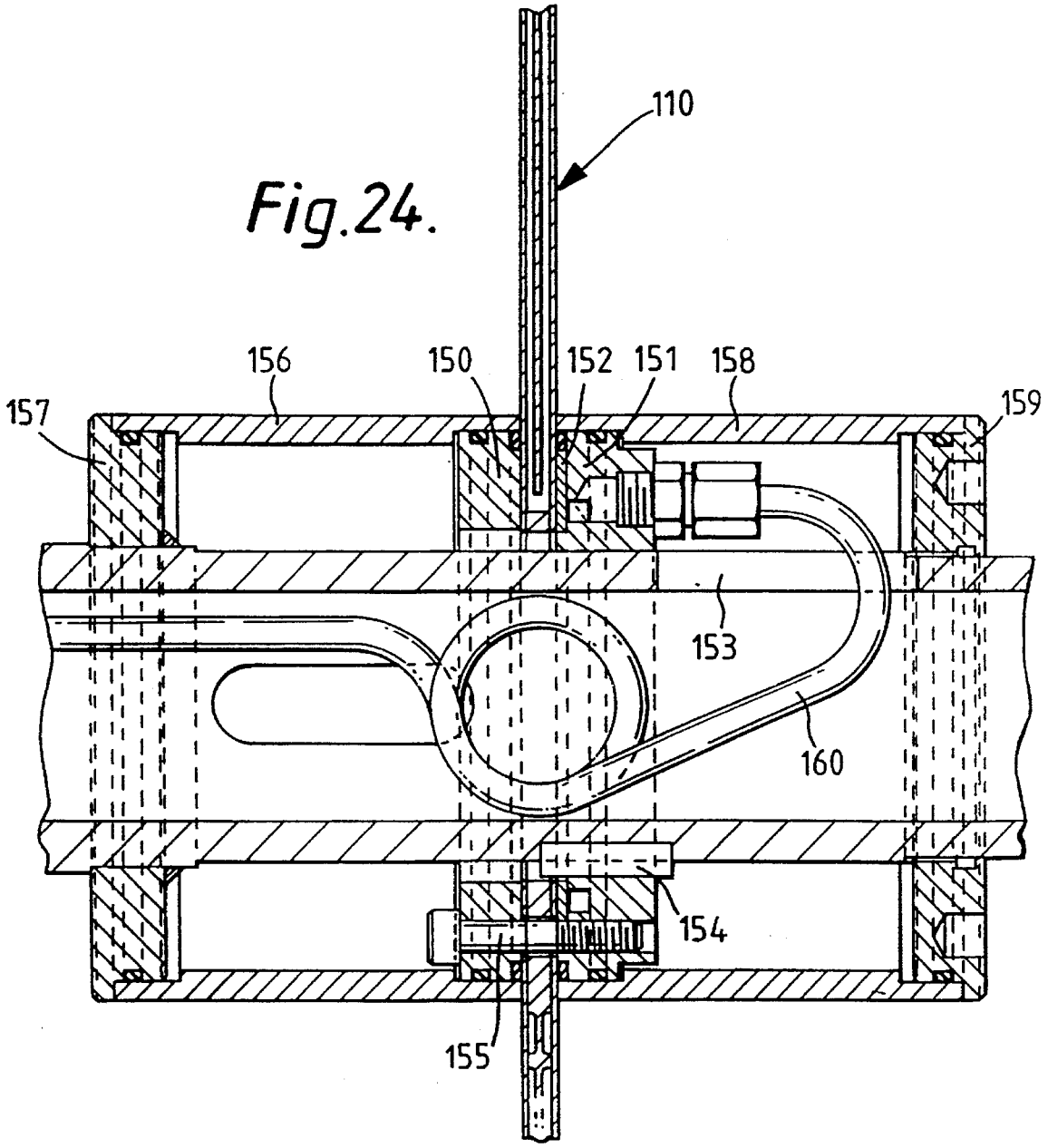
FIG. 24 is a sectional elevational view of a disc mounting arrangement.

A mounting arrangement for the disc is illustrated in FIG. 24. The disc 110 is clamped between two annular hubs 150, 151. An annular plate 152 is sandwiched between the disc 110 and one hub 151. Orifices are provided in the plate 152 to allow fluid communication with the openings 115 in the plate 110.

The hubs 150, 151, together with the plate 110 sandwiched therebetween are slidably mounted on a hollow shaft 153. Hub 151 is rotationally keyed to the shaft 153 by key 154. The hubs 150, 151 are secured together by threaded fasteners 155 which pass through axial openings 117 in disc 110.

The hub 150 is fixed axially relatively to the shaft 123 by sleeves 156 which abuts an annular flange 157, the flange 157 being fixed relative to shaft 153. The hub 151 is retained axially by a sleeve 158 which, in turn, is held in position by a collar or nut 159 on the sleeve 153. O-ring seals and other sealing arrangements are suitably provided between the various components of the mounting arrangement.

The above-described and illustrated mounting arrangement permits flexibility of design. For example, additional discs may be mounted to the shaft 123 by removing the collar nut 159 and adding more hubs and spacers, as required.

In use, refrigerant is delivered in a conduit 160 through a plurality of orifices in the plate 152 to the inlets 115 of the disc 110. From there, the refrigerant travels through the disc 110 to its outer periphery and then meanders back to the radial outlet 116 in the disc. The radial outlets 116 communicate with the interior of shaft 153 from where the refrigerant is extracted to a pump or low pressure receiver.

The foregoing describes only some embodiments of the present invention and modifications which are obvious to those skilled in the art may be made thereto without departing from the scope of the invention. For example, although a circular disc is preferred, the ice making machine may use a disc of other shape such as hexagonal or octagonal. The construction of the disc can be varied to include more than two layers bonded or brazed together, or alternatively, the disc can be manufactured by sandwiching a pipe coil between two flat metal discs.

In an alternative embodiment of the invention (not illustrated), the disc is held stationary and the ice removed by a rotating blade. The blade can be fitted with water application means on its trailing side so that as the leading edge removes the ice from the disc, the trailing edge leaves a layer of water which freezes by the time that the leading edge completes a full revolution. The water application means can take the form of a series of water jets or sprays.

While the ice making machines have been described with particular reference to flake ice manufacture, the invention is not limited thereto. For example, the ice making machines of the present invention may also be used to manufacture a slush ice product from fruit juice or cordial. On a larger scale, the machines could also be used to make imitation snow.

We claim:

1. A refrigerating disc suitable for use as an evaporator in a refrigeration circuit in an ice making machine, said disc being of planar form and having liquid freezing surfaces on both sides thereof, the disc being of laminated construction comprising at least two layers bonded rigidly together to form a unitary structure, at least one layer having open channels therein which, after the layers are bonded together, form a plurality of relatively narrow sinuous internal channels sized to accommodate the passage of an evaporative refrigerant therethrough, said channels being substantially of the same equivalent length and extending substantially throughout all of the operative portions of the disc so that the liquid freezing surfaces are close to and are chilled by the refrigerant passing through the channels, said disc including an inner centrally disposed portion having inlet aperture means in communication with the said internal channels at one end thereof serving to permit introduction of the refrigerant into the disc, and outlet aperture means in communication with said internal channels at another end thereof serving to permit removal of the refrigerant from the disc.

2. A refrigerating disc as claimed in claim 1, wherein the disc comprises two outer layers having plane surfaces and a third layer sandwiched between the two outer layers, the third layer having the open channels formed on both sides thereof which, when the layers are bonded together, form said internal channels between the third layer and a respective one of the outer layers.

3. A disc as claimed in claim 1, wherein the open channels are formed by chemical etching.

4. A disc as claimed in claim 1, wherein said open channels are formed by milling.

5. A disc as claimed in claim 1, comprising two outer layers having plane surfaces and a third layer sandwiched between the two outer layers, the third layer having through channels formed therein which, when the layers are bonded together, form said internal channels between the two outer layers.

6. A disc as claimed in claim 5, wherein said through channels are formed by laser cutting.

7. A disc as claimed in claim 5, wherein said through channels are formed by routing.

8. A disc as claimed in claim 1, wherein said disc comprises two layers bonded together, at least one of the layers having open channels formed therein which, when the layers are bonded together, form the internal channels between the two layers.

9. A disc as claimed in claim 8, wherein said open channels are formed by etching.

10. A disc as claimed in claim 1 wherein said internal channels course from said inlet means generally outwardly towards the perimeter of said disc and thence generally towards the inner portion.

11. A disc as claimed in claim 1 wherein the centrally disposed portion includes an aperture, said inlet aperture means comprising axially orientated openings on the disc adjacent the aperture and said outlet aperture means comprising radially orientated openings communicating with the aperture.

12. A disc as claimed in claim 8, wherein open channels are formed in both said layers in patterns which are mirror images of each other, the two layers being bonded together such that the patterns are aligned whereby the open channels form said internal channels between the two layers.

13. A refrigerating disc as claimed in claim 1, wherein the disc comprises two outer layers, each outer layer having a substantially planar outer surface and having the open channels formed on its inner surface.

14. A refrigerating disc as claimed in claim 1 wherein the channels have similar geometric patterns.

15. A refrigerating disc suitable for use as an evaporator in a refrigeration circuit in an ice making machine, said disc being of planar form and having liquid freezing surfaces on both sides thereof, the disc being of laminated construction comprising at least two layers bonded rigidly together to form a unitary structure, at least one layer having open channels formed therein by chemical etching, the open channels forming, after the layers are bonded together, a plurality of relatively narrow sinuous internal channels sized to accommodate the passage of an evaporative refrigerant therethrough, said channels extending substantially throughout all of the operative portions of the disc so that the liquid freezing surfaces are close to and are chilled by the refrigerant passing through the channels, said disc including an inner centrally disposed portion having inlet aperture means in communication with the said internal channels at one end thereof serving to permit introduction of the refrigerant into the disc, and outlet aperture means in communication with said internal channels at another end thereof serving to permit removal of the refrigerant from the disc.

16. A refrigerating disc as claimed in claim 15, wherein the disc comprises three layers and the internal channels are formed between the middle one of the three layers and the two outer layers.

* * * * *